United States Patent [19]

Curtis et al.

[11] Patent Number: 4,999,061

[45] **Date of Patent: * Mar. 12, 1991**

[54] LOW TEMPERATURE UNDERAGING OF LITHIUM BEARING ALLOYS AND METHOD THEREOF

[75] Inventors: R. Eugene Curtis, Issaquah; G. Hari Narayanan, Seattle; William E. Quist, Redmond, all of Wash.

[73] Assignee: The Boeing Company, Seattle, Wash.

[ * ] Notice: The portion of the term of this patent subsequent to Jun. 20, 2006 has been disclaimed.

[21] Appl. No.: 337,956

[22] Filed: Apr. 14, 1989

Related U.S. Application Data

[63] Continuation of Ser. No. 800,503, Nov. 21, 1985, Pat. No. 4,840,682, which is a continuation-in-part of Ser. No. 567,227, Dec. 30, 1983, abandoned.

[51] Int. Cl.[5] ..... C22F 1/04

[52] U.S. Cl. ..... 148/12.7 A; 148/159; 148/438; 148/439

[58] Field of Search ..... 148/12.7 A, 159, 438, 148/439

[56] References Cited

U.S. PATENT DOCUMENTS 4,840,682 6/1989 Curtis et al. ..... 148/12.7 A

*Primary Examiner*—Deborah Yee

*Attorney, Agent, or Firm*—Christensen, O'Connor, Johnson & Kindness

[57] ABSTRACT

The combination of strength and fracture toughness properties of aluminum-lithium alloys are significantly enhanced by underaging the alloys at temperatures ranging from 200° F. to below 305° F. for relatively long periods of time.

6 Claims, 1 Drawing Sheet

LOW TEMPERATURE UNDERAGING OF LITHIUM BEARING ALLOYS AND METHOD THEREOF

This application is a continuation of application Ser. No. 06/800,503, filed Nov. 21, 1985 now U.S. Pat. No. 4,840,682 which is a continuation-in-part of application Ser. No. 06/567,227, filed Dec. 30, 1983, now abandoned.

TECHNICAL FIELD

The invention relates to aluminum alloys containing lithium as an alloying element, and particularly to a process for improving the fracture toughness of aluminum-lithium alloys without detracting from their strength.

BACKGROUND OF THE INVENTION

It has been estimated that some current large commercial transport aircraft may be able to save from 15 to 20 gallons of fuel per year for every pound of weight that can be saved when building the aircraft. Over the projected 20 year life of an airplane, this savings amounts to 300 to 400 gallons of fuel. At current fuel costs, a significant investment to reduce the structural weight of the aircraft can be made to improve overall economic efficiency of the aircraft.

The need for improved performance in aircraft of various types can be satisfied by the use of improved engines, improved airframe design, or by the use of new or improved structural materials. Improvements in engines and aircraft design have been vigorously pursued, but only recently has the development of new and improved structural materials received commensurate attention, and their implementation in new aircraft designs is expected to yield significant gains in performance.

Materials have always played an important role in dictating aircraft structural concepts. Since the early 1930's, structural materials for large aircraft have remained remarkably consistent, with aluminum being the primary material of construction in the wing, body and empennage, and with steel being utilized for landing gears and certain other speciality applications requiring very high strength. Over the past several years, however, several important new materials concepts have been under development for incorporation into aircraft structures. These include new metallic materials, metal matrix composites and resin matrix composites. It is believed by many that improved aluminum alloys and carbon fiber resin matrix will dominate aircraft structural materials in the coming decades. While composites will be used in increased percentages as aircraft structural materials, new lightweight aluminum alloys, and especially aluminum-lithium alloys show great promise for extending the usefulness of materials of this type.

Heretofore, aluminum-lithium alloys have been used only sparsely in aircraft structures. The low use has been caused by their relatively low fracture toughness and by casting difficulties associated with lithium-bearing aluminum alloys compared to other more conventional aluminum alloys. Lithium additions to aluminum, however, provide a substantial lowering of the density which has been determined to be very important in decreasing the overall structural weight of aircraft. While substantial strides have been made in improving the aluminum-lithium processing technology, a major challenge is still to obtain a good blend of fracture toughness and high strength in these alloys.

SUMMARY OF THE INVENTION

The present invention provides a method for aging aluminum-lithium alloys of various compositions at relatively low temperatures to develop a high and improved fracture toughness without reducing the strength of the alloy. Simply, after the alloy is formed into an article, solution heat treated and quenched, the alloy is aged at a relatively low temperature for a relatively long time. This process may be generally referred to as low temperature underaging. More specifically, the alloy can be aged at temperatures ranging from 200° F. to below 305° F. for a period of time ranging from 1 up to 80 or more hours. This low temperature aging regimen will result in an alloy having a greater fracture toughness, often on the order of 150 to 200 percent, than that of materials aged at conventional higher temperatures while maintaining an equivalent strength.

BRIEF DESCRIPTION OF THE DRAWING

A better understanding of the present invention can be derived by reading the ensuing specification in conjunction with the accompanying drawing wherein.

DETAILED DESCRIPTION OF THE INVENTION

Figure 1:
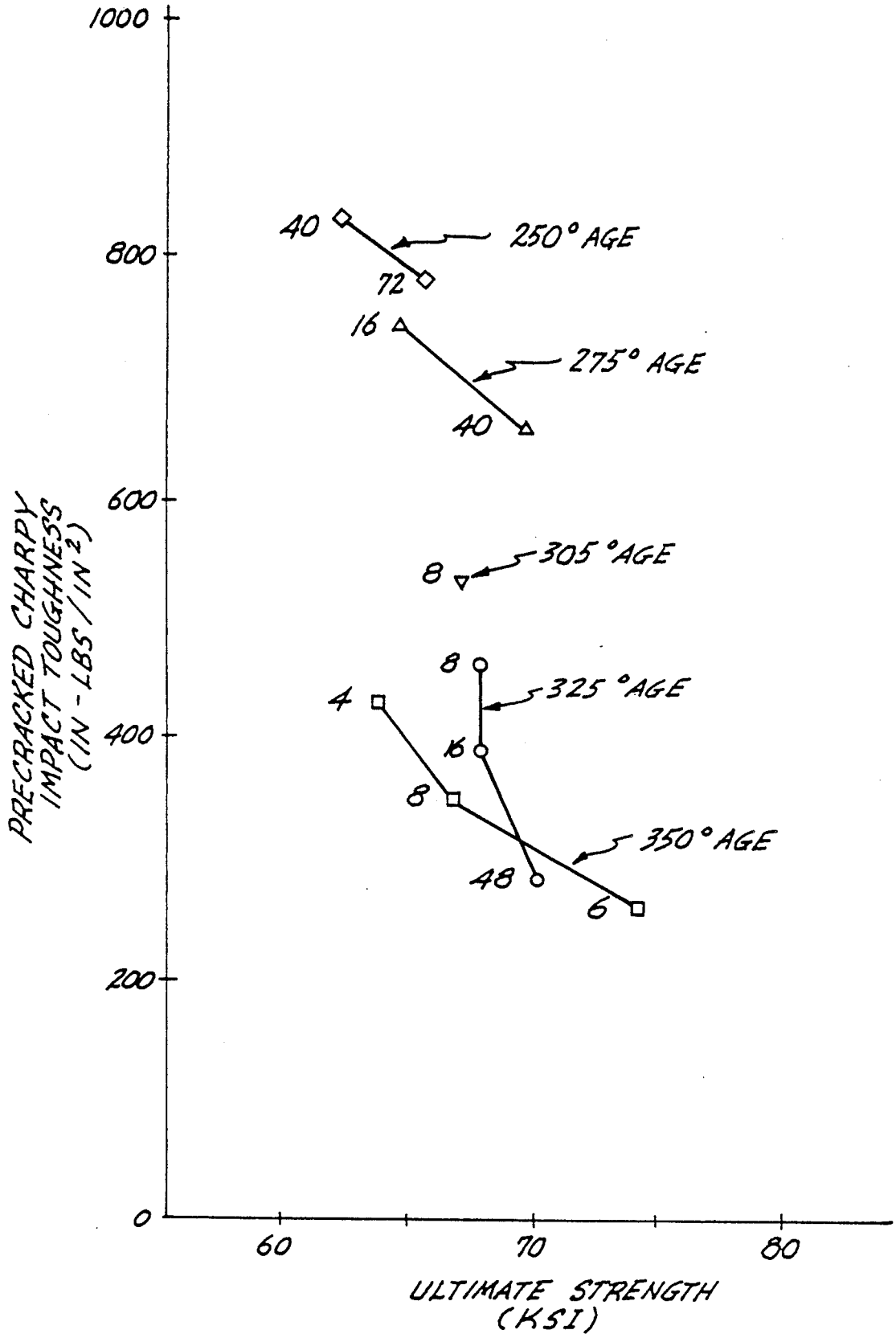
FIG. 1 is a graph showing fracture toughness/-strength combinations of several specimens of an aluminum-lithium alloy aged at various times and various temperatures as described in the Example.

An aluminum-lithium alloy formulated in accordance with the present invention can contain from about 1.0 to about 3.2 percent lithium. The current data indicates that the benefits of the low temperature underaging are most apparent at lithium levels of 2.7 percent and below. All percentages herein are by weight percent (wt %) based on the total weight of the alloy unless otherwise indicated. Additional alloying agents such as magnesium, copper and manganese can also be included in the alloy. Alloying additions function to improve the general engineering properties but also affect density somewhat. Zirconium is also present in these alloys as a grain refiner at levels between 0.08 to 0.15 percent. Zirconium is essential to the development of the desired combination of engineering properties in aluminum-lithium alloys, including those subjected to our low temperature underaging treatment.

The impurity elements iron and silicon can be present in amounts up to 0.3 and 0.5 percent, respectively. It is preferred, however, that these elements be present only in trace amounts of less than 0.10 percent. Certain trace elements such as zinc and titanium may be present in amounts up to but not to exceed 0.25 percent and 0.15 percent, respectively. Certain other trace elements such as cadmium and chromium must each be held to levels of 0.05 percent or less. If these maximums are exceeded, the desired properties of the aluminum-lithium alloy will tend to deteriorate. The trace elements sodium and hydrogen are also thought to be harmful to the properties of aluminum-lithium alloys and should be held to the lowest levels practically attainable, for example on the order of 15 to 30 ppm (0.0015–0.0030 wt %) maximum for the sodium and less than 15 ppm (0.0015 wt %) and preferably less than 1.0 ppm (0.0001 wt %) for the hydrogen. The balance of the alloy, of course, comprises aluminum.

The following Table represents the proportions in which the alloying and trace elements may be present. The broadest ranges are acceptable under some circumstances, while the preferred ranges provide a better balance of fracture toughness and strength. The most preferred ranges yield alloys that presently provide the best set of overall properties for use in aircraft structures.

TA8LE

| Element | Amount (wt %) | | |
|---|---|---|---|
| | Acceptable | Preferred | Most Preferred |
| Li | 1.0 to 3.2 | 1.5 to 3.0 | 1.8 to 2.7 |
| Mg | 0 to 5.5 | 0 to 4.2 | 0 to 3.2 |
| Cu | 0 to 4.5 | 0 to 3.7 | 0.5 to 3.0 |
| Zr | 0.08 to 0.15 | 0.08 to 0.15 | 0.08 to 0.15 |
| Mn | 0 to 1.2 | 0 to 0.8 | 0 to 0.6 |
| Fe | 0.3 max | 0.15 max | 0.10 max |
| Si | 0.5 max | 0.12 max | 0.10 max |
| Zn | 0.25 max | 0.10 max | 0.10 max |
| Ti | 0.15 max | 0.10 max | 0.10 max |
| Na | 0.0030 max | 0.0015 max | 0.0015 max |
| H | 0.0015 max | 0.0005 max | 0.0001 max |
| Other trace elements | | | |
| each | 0.05 max | 0.05 max | 0.05 max |
| total | 0.25 max | 0.25 max | 0.25 max |
| Al | Balance | Balance | Balance |

An aluminum-lithium alloy formulated in the properties set forth in the foregoing paragraphs and Table is processed into an article utilizing known techniques. The alloy is formulated in molten form and cast into an ingot. The ingot is then homogenized at temperatures ranging from 925° F. to approximately 1000° F. Thereafter, the alloy is converted into a usable article by conventional mechanical forming techniques such as rolling, extrusion or the like. Once an article is formed, the alloy is normally subjected to a solution treatment at temperatures ranging from 950° F. to 1010° F., followed by quenching into a medium such as water that is maintained at a temperature on the order of 70° F. to 150° F. If the alloy has been rolled or extruded, it is generally stretched on the order of 1 to 3 percent of its original length to relieve internal stresses and improve engineering properties. The aluminum alloy may then be further worked and formed into the various shapes for its final application. Additional heat treatments such as those outlined above may then be employed if desired.

Thereafter, in accordance with the present invention, the article is subjected to an aging treatment that will increase the strength of the material while maintaining its fracture toughness and other engineering properties at relatively high levels. In accordance with the present invention, the article is subjected to a low temperature underage heat treatment at temperatures ranging from about 200° F. to less than 305° F. Low temperature underaging at temperatures in the range of from about 250° F. to about 275° F. is considered preferred for most alloys, taking into consideration the economic impetus for minimizing the time spent in commercial heat-treatment facilities. At the higher temperatures, less time is needed to bring about the proper balance between strength and fracture toughness than at lower aging temperatures, but the overall property mix will be slightly less desirable. For example, when the aging is conducted at temperatures on the order of 275° F. to just below 305° F., it is preferred that the product be subjected to the aging temperature for periods of from 1 to 40 hours. On the other hand, when aging is conducted at temperatures on the order of 250° F. or below, aging times from 2 to 80 hours or more are preferred to bring about the proper balance between fracture toughness and strength. After the aging treatment, the aluminum-lithium article is cooled to room temperature.

When the low temperature underaging treatment is conducted in accordance with the parameters set forth above, the treatment will result in an aluminum-lithium alloy having an ultimate strength typically on the order of 45 to 95 ksi, depending on the composition of the particular alloy. The fracture toughness of the alloy will be greater, often on the order of 1½ to 2 times greater, than that of similar aluminum-lithium alloys aged to equivalent strength levels by conventional aging treatments at temperatures greater than 305° F.

The following Example is presented to illustrate the superior strength and toughness combination achieved by low temperature underaging an aluminum-lithium alloy in accordance with the present invention and to assist one of ordinary skill in making and using the present invention. The following Example is not intended in any way to otherwise limit the scope of this disclosure or the protection granted by Letters Patent hereon.

EXAMPLE

An aluminum alloy containing 2.4 percent lithium, 1 percent magnesium, 1.3 percent copper, 0.15 percent zirconium with the balance being aluminum was formulated. The trace elements present in the formulation constituted less than 0.25 percent of the total. The iron and silicon present in the formulation constituted less than 0.07 percent each of the formulation. The alloy was cast and homogenized at 975° F. Thereafter, the alloy was hot rolled to a thickness of 0.2 inches. The resulting sheet was then solution treated at 975° F. for about 1 hour. The sheet was then quenched in water maintained at about 70° F. Thereafter, the sheet was subjected to a stretch of 1½ percent of its initial length and was then cut into specimens. Some specimens were cut to a size of 0.5 inch by 2.5 inch by 0.2 inch for precrack Charpy impact tests, a known method of measuring fracture toughness. Other specimens prepared for tensile strength tests were 1 inch by 4 inches by 0.2 inches. A plurality of specimens were then aged at 350° F. for 4, 8, and 16 hours; at 325° F. for 8, 16, and 48 hours; at 305° F. for 8 hours; at 275° F. for 16 and 40 hours; and at 250° F. for 40 and 72 hours. Specimens aged at each of the temperatures and times were then subjected to precrack Charpy impact and tensile strength tests in accordance with standard testing procedures. The test values of the specimens aged at a particular temperature and time were then averaged. These average test values are set forth in the graph shown in FIG. 1.

By examining FIG. 1 it will be readily observed that specimens aged at temperatures greater than 300° F. exhibited a toughness on the order of from 250 to 460 inch-pounds per square inch as measured by the Charpy impact test. In contrast, the specimens underaged at a low temperature in accordance with the present invention exhibited toughnesses on the order of 530 to almost 850 inch-pounds per square inch as indicated by the Charpy impact test. At the same time, the average strengths of the materials fell generally within the 64 to 71 ksi range, with the exception of the specimens aged at 350° F. for 16 hours. (The 350° F. age specimens, however, exhibited the lowest toughness of any of the specimens.) Thus, the test results indicate that aging at a temperature less than 305° F. for a relatively long time will clearly provide a strength/toughness combination that is superior to that of specimens aged in accordance with conventional procedures at temperatures on the order of 325° to 350° F. or more for relatively short periods of time. The test results also show that there is a remarkable improvement in the strength-toughness combination of properties as the aging temperature is lowered below 305° F., i.e., a higher fracture toughness for any given strength level.

The present invention has been described in relation to various embodiments, including the preferred processing parameters and formulations. One of ordinary skill after reading the foregoing specification will be able to effect various changes, substitutions of equivalents and other alterations without departing from the broad concepts disclosed herein. For example, it is contemplated that the subject low temperature underaging treatment may be applicable to other alloying combinations not now under development, and specifically to aluminum-lithium alloys with substantial amounts of zinc, silicon, iron, nickel, beryllium, bismuth, germanium, and/or zirconium. It is therefore intended that the scope of Letters Patent granted hereon will be limited only by the definition contained in the appended claims and equivalents thereof.

The embodiments of the invention in which an exclusive property or privilege is claimed are defined as follows:

1. A process for intentionally improving the fracture toughness of an aluminum-lithium alloy without detracting from the strength of said alloy, said alloy consisting essentially of:

| Element | Amount (wt %) |
|---|---|
| Li | 1.0 to 3.2 |
| Mg | 0 to 5.5 |
| Cu | 0 to 4.5 |
| Zr | 0.08 to 0.15 |
| Mn | 0 to 1.2 |
| Fe | 0.3 max |
| Si | 0.5 max |
| Zn | 0.25 max |
| Ti | 0.15 max |
| Other trace elements | |
| each | 0.05 max |
| total | 0.25 max |

-continued

| Element | Amount (wt %) |
|---|---|
| Al | Balance, |

said alloy first being formed into an article, solution heat treated and quenched, said process comprising the step of aging said alloy article to a predetermined underaged strength level at from about 200° to 305° F.

2. The alloy article produced by the process of claim 1.

3. The process of claim 1, wherein said alloy consists essentially of:

| Element | Amount (wt %) |
|---|---|
| Li | 1.5 to 3.0 |
| Mg | 0 to 4.2 |
| Cu | 0 to 3.7 |
| Zr | 0.08 to 0.15 |
| Mn | 0 to 0.8 |
| Fe | 0.15 max |
| Si | 0.12 max |
| Zn | 0.10 max |
| Ti | 0.10 max |
| Other trace elements | |
| each | 0.05 max |
| total | 0.25 max |
| Al | Balance. |

4. The alloy article produced by the process of claim 3.

5. The process of claim 1, wherein said alloy consists essentially of:

| Element | Amount (wt %) |
|---|---|
| Li | 1.8 to 2.7 |
| Mg | 0 to 3.2 |
| Cu | 0.5 to 3.0 |
| Zr | 0.08 to 0.15 |
| Mn | 0 to 0.6 |
| Fe | 0.10 max |
| Si | 0.10 max |
| Zn | 0.10 max |
| Ti | 0.10 max |
| Other trace elements | |
| each | 0.05 max |
| total | 0.25 max |
| Al | Balance. |

6. The alloy article produced by the process of claim 5.

* * * * *

UNITED STATES PATENT AND TRADEMARK OFFICE

CERTIFICATE OF CORRECTION

PATENT NO. : 4,999,061

DATED : March 12, 1991

INVENTOR(S) : R.E. Curtis et al.

It is certified that error appears in the above-identified patent and that said Letters Patent is hereby corrected as shown below:

| Column | Line | |
|---|---|---|
| [57] | 5 | delete "below" |
| 2 | 15 | delete "below" |
| 3 | 9 | "TA8LE" should be --TABLE-- |
| 3 | 54 | delete "less than" |
| 3 | 65 | delete "just below" |
| 4 | 56 | "300°F." should be --305°F-- |
| 5 | 1 | "less than 305°F." should be --305°F. or less-- |

Signed and Sealed this

Twenty-second Day of September, 1992

*Attest:*

DOUGLAS B. COMER

*Attesting Officer*

*Acting Commissioner of Patents and Trademarks*